US007850469B2

(12) United States Patent
Kobayashi

(10) Patent No.: US 7,850,469 B2
(45) Date of Patent: Dec. 14, 2010

(54) CONNECTOR ASSEMBLY WITH A CASE AND A DUMMY CONNECTOR HAVING A GUIDE PROJECTION WITH A TRANSVERSE PROTRUSION

(75) Inventor: Yuka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/501,664

(22) Filed: Jul. 13, 2009

(65) Prior Publication Data

US 2010/0015827 A1 Jan. 21, 2010

(30) Foreign Application Priority Data

Jul. 18, 2008 (JP) ..... 2008-187455

(51) Int. Cl.
*H01R 13/44* (2006.01)

(52) U.S. Cl. ..... 439/148

(58) Field of Classification Search ..... 439/587, 439/148, 589, 274, 275
See application file for complete search history.

(56) References Cited

U.S. PATENT DOCUMENTS

| | | | | |
|---|---|---|---|---|
| 5,551,892 | A * | 9/1996 | Endo et al. | 439/587 |
| 6,390,848 | B1 * | 5/2002 | Murakami et al. | 439/587 |
| 7,559,797 | B2 * | 7/2009 | Shishikura et al. | 439/587 |
| 2001/0024907 | A1 | 9/2001 | Murakami et al. | |

* cited by examiner

*Primary Examiner*—Chandrika Prasad
(74) *Attorney, Agent, or Firm*—Gerald E. Hespos; Michael J. Porco

(57) ABSTRACT

Male and female connectors (10, 50) include male and female housings (11, 51) with accommodating portions (25, 61) that have rear end insertion openings for accommodating dummy connectors (30, 70). The dummy connectors (30, 70) include protrusions (37, 78) that interfere with the opening edges of the accommodating portions (25, 61) and prevent insertion if the dummy connectors (30, 70) are reversed forward/backward. However, properly oriented dummy connectors (30, 70) can be inserted into the accommodating portions (25, 61) while leaving the protrusions (37, 70) projecting out from the insertion openings.

14 Claims, 14 Drawing Sheets

CONNECTOR ASSEMBLY WITH A CASE AND A DUMMY CONNECTOR HAVING A GUIDE PROJECTION WITH A TRANSVERSE PROTRUSION

BACKGROUND OF THE INVENTION

1. Field of the Invention

The invention relates to a connector.

2. Description of the Related Art

U.S. Patent Application Publication No. 2001/0024907 discloses a connector assembly with a dummy connector that is inserted into an accommodating portion of a case even though the dummy connector does not contribute to a circuit configuration. The dummy connector has a main body that closes an inner space of the accommodating portion to ensure a specified water resistance.

No wire extends from the main body of the dummy connector and it is difficult to distinguish the front end from the rear end. Thus, the main body of the dummy connector may be reversed in forward/backward directions during insertion into the accommodating portion. In such cases, an operator may mistakenly believe that an inserting operation has been completed even though the dummy connector main body has been inserted only to an intermediate position. Additionally, an operator may not notice that he or she has forgotten to insert the dummy connector main body into the accommodating portion.

The invention was developed to prevent the insertion of a dummy connector from being made in an erroneous manner and forgotten.

SUMMARY OF THE INVENTION

The invention relates to a connector assembly with a case that includes an accommodating portion with an insertion opening at one end. The connector assembly also includes at least one dummy connector that is inserted into the insertion opening of the accommodating portion. No wire is drawn out from the dummy connector. The dummy connector includes at least one protrusion that interferes with the opening edge of the insertion opening to prevent insertion of the dummy connector into the accommodating portion if the dummy connector is oriented improperly, such as a forward/backward reversal. However, the protrusion permits the properly oriented dummy connector to be inserted into the accommodating portion. Thus, an erroneous insertion of the dummy connector can be prevented.

The protrusion projects out from the insertion opening if the dummy connector is in the proper posture. Thus, a visual or tactile confirmation of a properly inserted state is provided and a worker will not forget to insert the dummy connector.

The connector preferably includes a housing region that can accommodate terminal fittings that are arranged side by side when the accommodating portion is in the case. Wires are connected with the terminal fittings and are drawn out from the housing region.

The insertion opening preferably is arranged at the same side as a wire draw-out surface in the housing region. Accordingly, the wires are located substantially side by side with the protrusion projecting from the opening edge of the insertion opening. Therefore a dead space is used effectively in an arrangement direction of the wires. Further, the wires prevent only a projecting state of the protrusion from standing out and problems, such as the interference of the protrusion with other components, are unlikely.

One end of the protrusion has a flat portion that can be pushed by a finger into the accommodating portion. This construction is simple as compared with the case where a pushable portion is on a part other than the protrusion.

At least one guiding projection is provided on an outer surface of the dummy connector main body for guiding the insertion of the dummy connector into the accommodating portion.

The protrusion preferably extends from one end of the guiding projection and is reinforced by the guiding projection. Thus, the protrusion is not likely to be broken by interference with external matter.

The protrusion preferably is connected integrally or unitarily with a rear end of the guiding projection and is reinforced by the guiding projection.

At least one lock preferably is provided on the dummy connector main body to engage at least one interlocking portion to retain the properly inserted dummy connector in the accommodating portion.

Locks project from the inner surfaces of two guiding projections that face each other and a clearance is defined between the locks. At least one restriction projects from the interlocking portion to restrict loose movements of the interlocking portion as the restriction enters the clearance between the locks. Thus, the locks and the restrictions are held stably.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
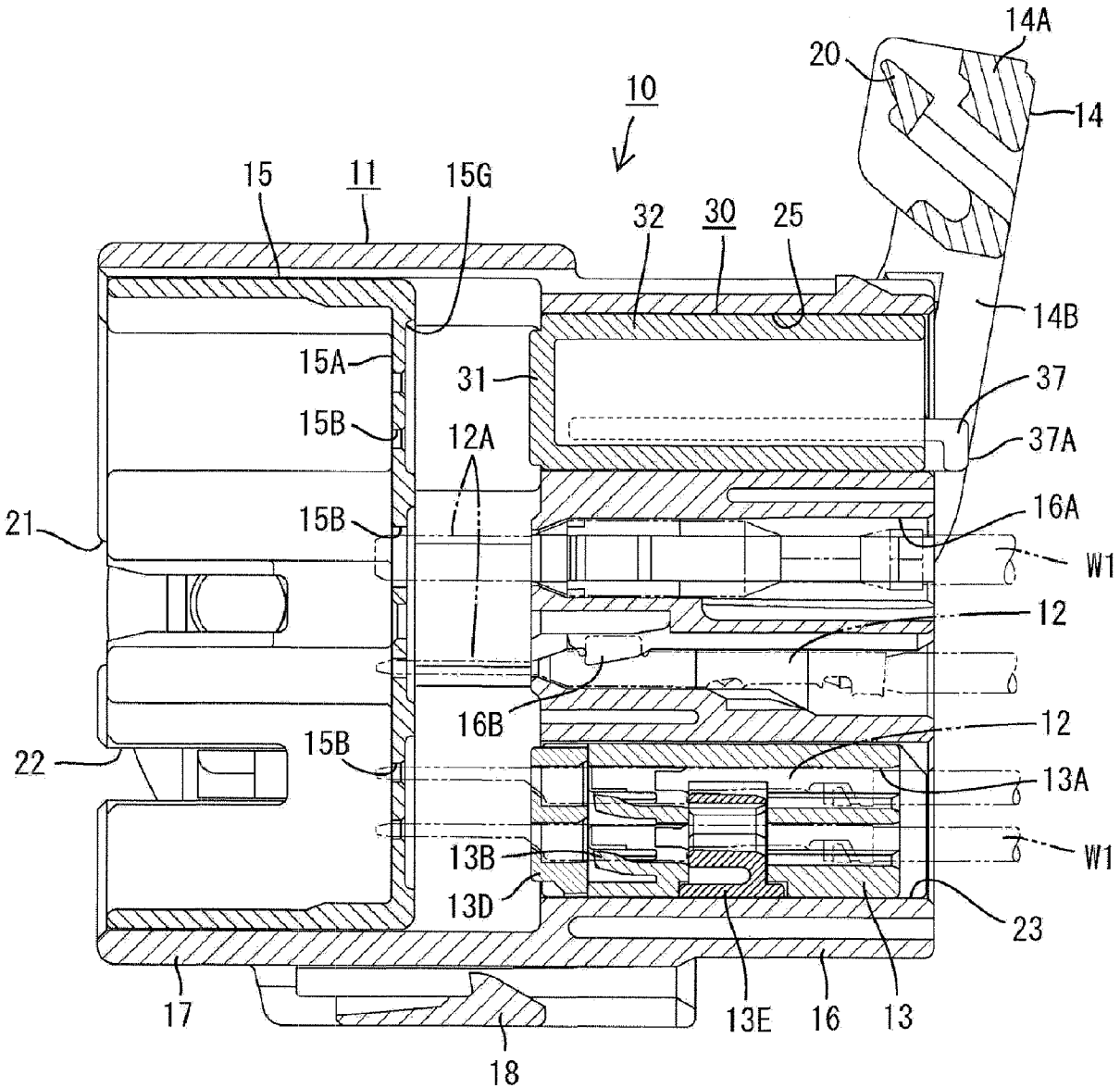
FIG. 1 is a side sectional view of a male connector of the invention.

A connector assembly in accordance with the invention is illustrated in FIGS. 1 to 17. The connector assembly comprises male and female connectors 10, 50 connectable with each other. The male connector 10 includes a male housing 11, male terminal fittings 12, at least one male-side dummy connector 30, at least one male-side housing 13, a lever 14 and a moving plate 15. The female connector 50 includes a female housing 51, female terminal fittings 52, a female-side dummy connector 70 and a female-side housing part 53. In the following description, ends of the two connectors 10, 50 to be connected are referred to as front ends.

Figure 3:
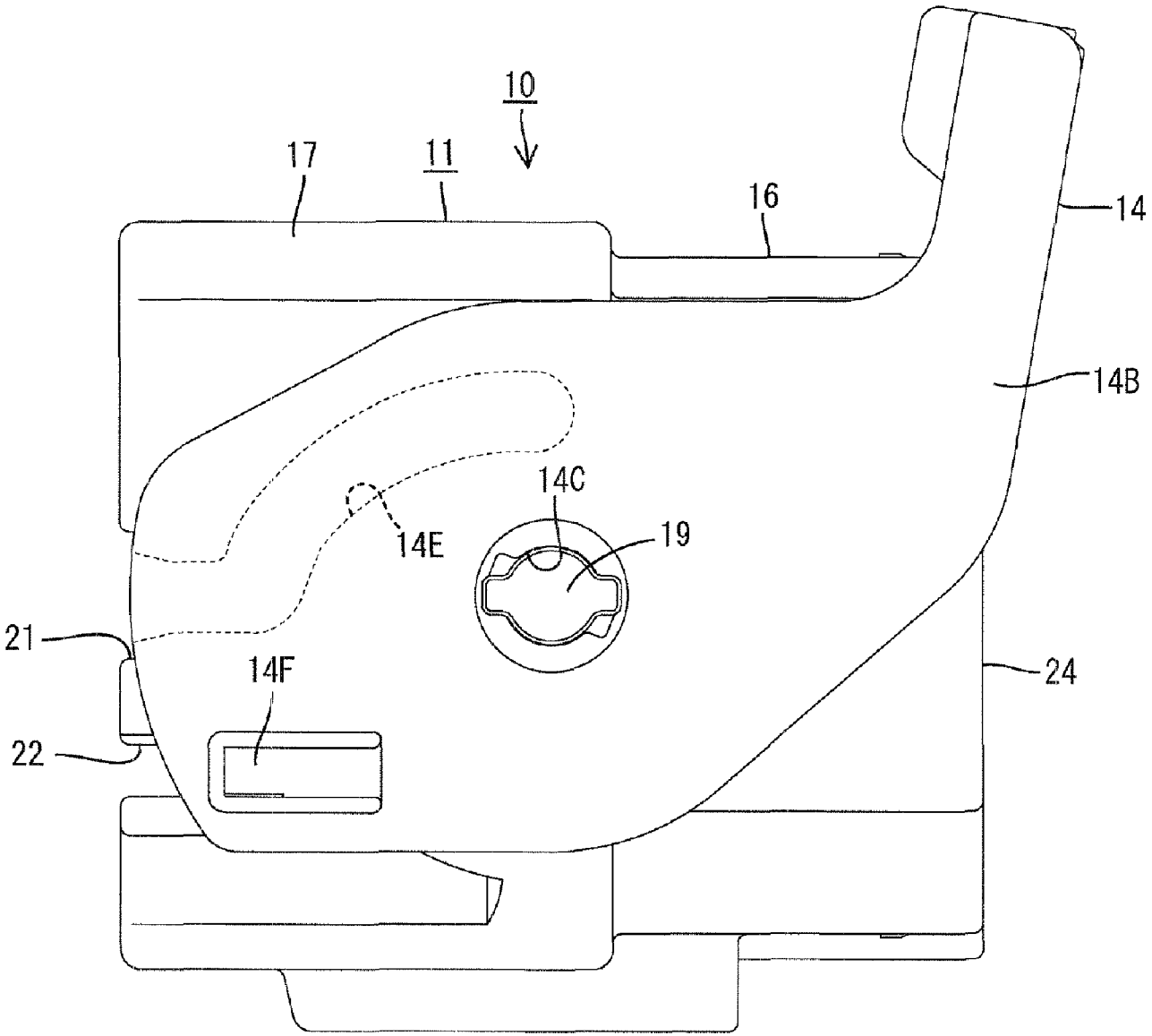
FIG. 3 is a side view of the male connector.

The male housing 11 is made e.g. of synthetic resin and includes block-shaped terminal accommodating portion 16 for accommodating the male terminal fittings 12 and a tubular receptacle 17 projecting forward from a peripheral edge of the front end of the terminal accommodating portion 16, as shown in FIG. 1. A mounting piece 18 projects back from the lower surface of the male housing 11 to mount the male housing 11 on an unillustrated external bracket. A substantially U-shaped lever 14 is mounted to straddle the male housing 11. The lever 14 has an operable portion 14A that extends in a width direction and parallel arms 14B project from the opposite ends of the operable portion 14A. Each arm 14B has a bearing hole 14C, as shown in FIG. 3. Supporting shafts 19 project on opposite side surfaces of the receptacle 17 of the male housing 11 near the terminal accommodating portion 16 and can be inserted into the bearing holes 14C of the arms 14B. The lever 14 is rotatable about the supporting shafts 19 between an initial position and a connection position. The operable portion 14A has a resiliently deformable lock 20 that engages a corresponding engaging portion 55 on the mating female housing 51 when the lever 14 reaches the connection position to lock the two housings 11, 51 in a connected state.

Figure 2:
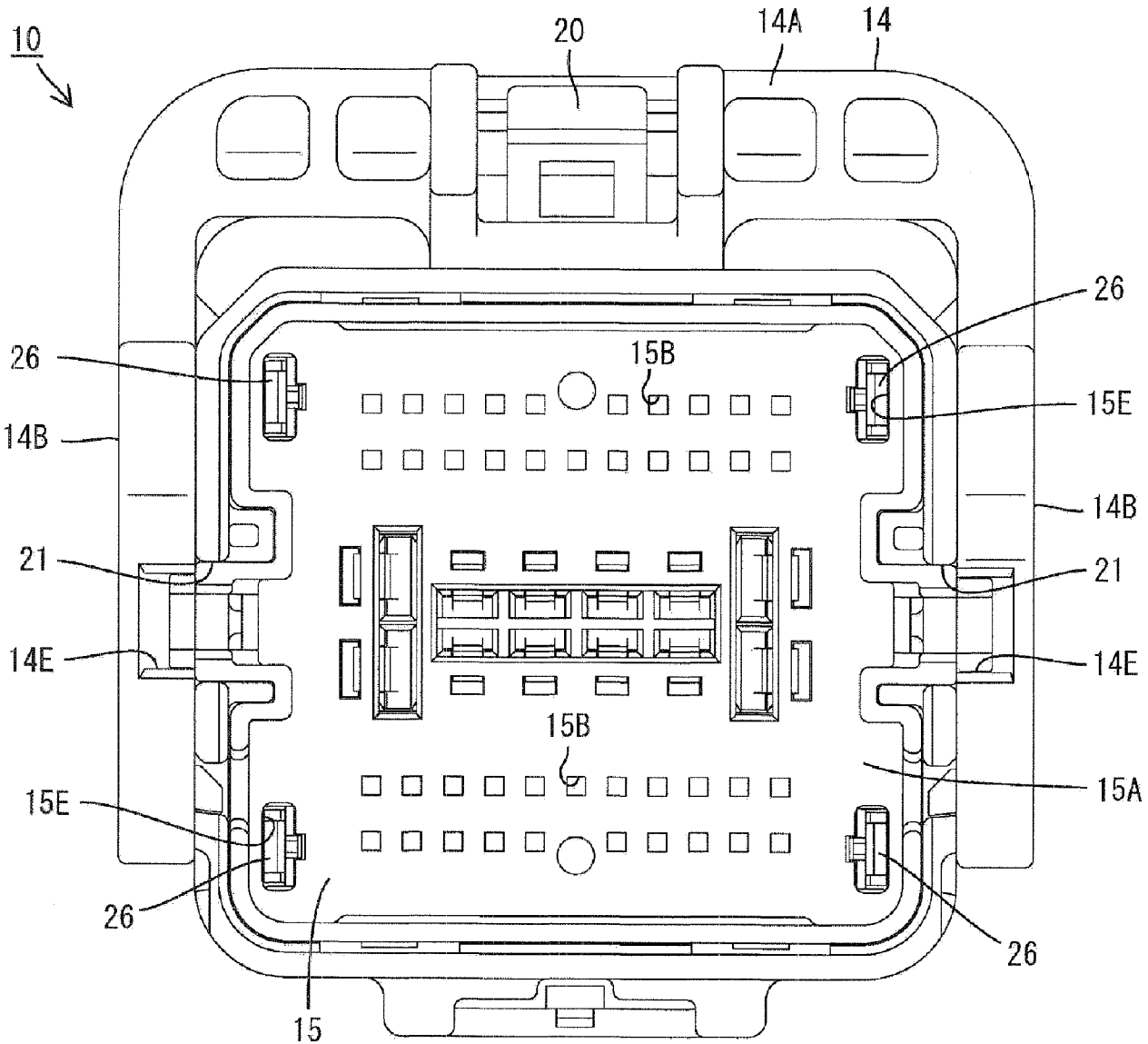
FIG. 2 is a front view of the male connector.

The inner surface of each arm 14B is recessed to form a cam groove 14E extending in a specified shape and having an entrance located at the peripheral edge of the arm 14B. The entrances of the cam grooves 14E open forward at the initial position. As shown in FIG. 2, introducing grooves 21 are formed in the opposite side walls of the receptacle 17 and extend forward and backward along a connecting direction of the male and female connectors. The introducing grooves 21 open at the front end of the receptacle 17 to communicate with the entrances of the cam grooves 14E near the initial position. Further, resilient locking pieces 14E are formed by cutting the arms 14B. The opposite side walls of the receptacle 17 also are formed with engaging grooves 22 that extend substantially parallel to the introducing grooves 21 and open at the front end of the receptacle 17 for receiving the resilient locking pieces 14F. At the initial position, the resilient locking pieces 14F engage edges of the engaging grooves 22 to prevent the rotation of the lever 14 toward the connection position.

The moving plate 15 is mounted in the receptacle 17 and includes a plate main body 15A that covers the front surface of the terminal accommodating portion 16 while being aligned parallel to the front surface. Positioning holes 15B penetrate the plate main body 15A to receive and position tabs 12A of the male terminal fittings 12. The moving plate 15 is movable between an advanced position that is distant from the front surface of the terminal accommodating portion 16 and a retracted position near the front surface of the terminal accommodating portion 16. Leading ends of the tabs 12A pass through the positioning holes 15B and are protected by the moving plate 15 when the moving plate 15 is at the advanced position. However, base ends of the tabs 12A are passed through the positioning holes 15B when the moving plate 15 is at the retracted position.

Cavities 16A penetrate the terminal accommodating portion 16 in forward and backward directions. The cavities 16A are arranged in upper and lower levels in an intermediate part of the terminal accommodating portion 16 in a height direction. Male terminal fittings 12 are insertable into the cavities 16A from behind. The male terminal fittings 12 in the upper level and at the opposite sides are larger than those 12 in the lower level or at an intermediate part. The male terminal fittings 12 at the opposite sides and in the intermediate part are inserted into the cavities 16A with their inserting postures being displaced by substantially 90° about longitudinal axes. In other words, the terminal fittings 12 are accommodated in the cavities 16A of the terminal accommodating portion 16 with two different orientations, depending on their position in the terminal accommodating portion 16. A resiliently deformable locking lance 16B is provided at an inner wall of each cavity 16A for retaining the male terminal fitting 12 in the respective cavity 16A.

A first accommodating portion 23 penetrates a lower part of the terminal accommodating portion 16 in forward and backward directions. The male housing part 13 is to be accommodated in the first accommodating portion 23, and the rear end opening of the first accommodating portion 23 defines an insertion opening for receiving the male-side housing part 13. Cavities 13A penetrate the male-side housing part 13 in forward and backward directions. The cavities 13A are arranged in upper and lower levels and small male terminal fittings 12 are inserted into the cavities 13A from behind. A resiliently deformable locking lance 13B is provided at an inner wall of each cavity 13A. A front holder 13D is mounted on a front end portion of the male-side housing part 13 and a retainer 13E is mounted in an intermediate part of the male-side housing part 13. The rear end surface of the male housing part 11 is substantially vertical as shown in FIG. 3, and an area thereof from a middle part to the lower part defines a wire draw-out surface 24 through which wires W1 connected with the large and small male terminal fittings 12 are drawn out.

A second accommodating portion 25 penetrates an upper part of the terminal accommodating portion 16 in forward and backward directions and has substantially the same shape as the first accommodating portion 23. The male housing part 13 can be accommodated in the second accommodating portion 25 similar to the first accommodating portion 23. In this embodiment, the second accommodating portion 25 has no function and the male-side dummy connector 30, which does not contribute to a circuit configuration, is accommodated therein. The rear end opening of the second accommodating portion 25 defines an insertion opening for receiving the male-side dummy connector 30.

Figure 4:
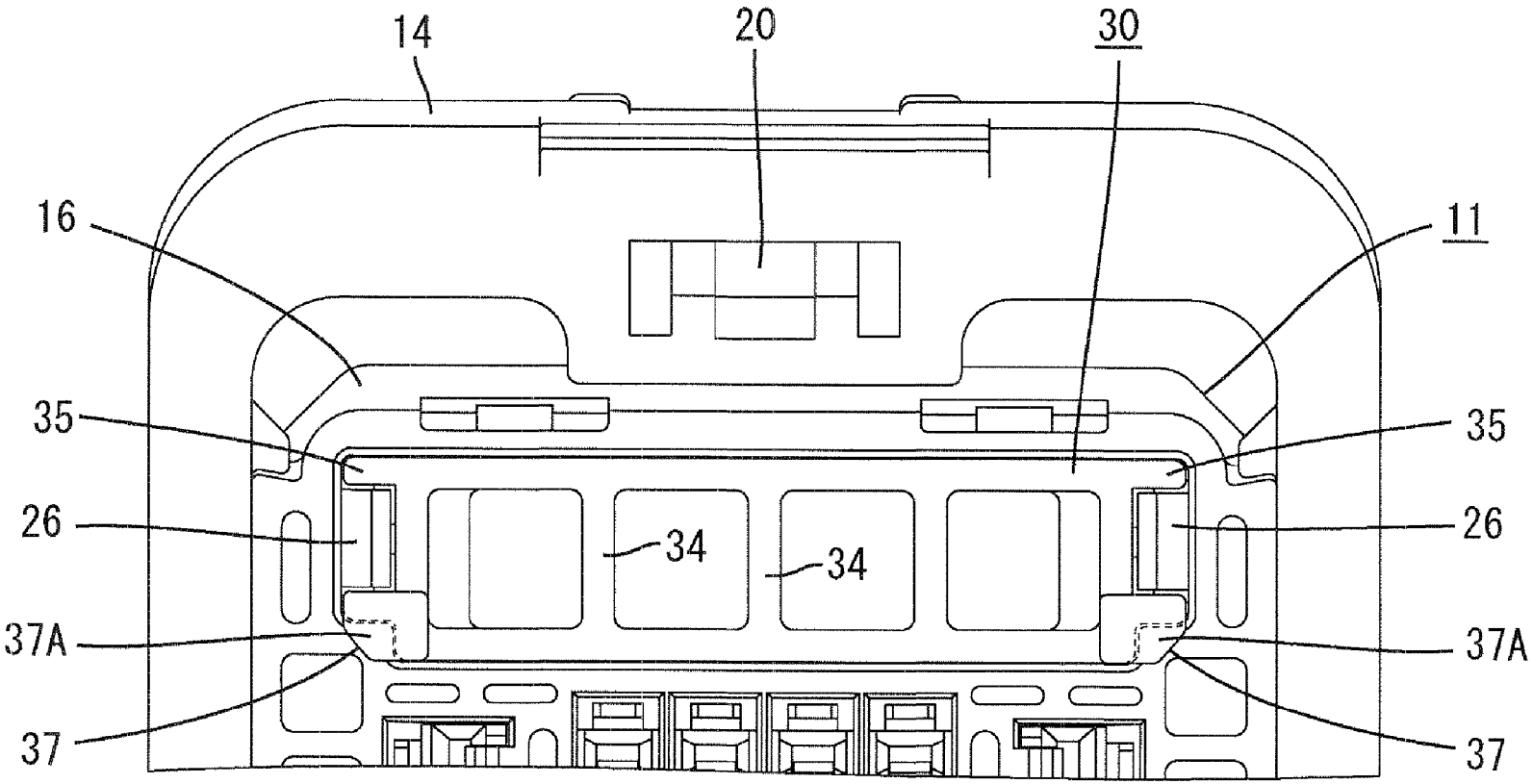
FIG. 4 is an enlarged rear view of a male-side dummy connector inserted properly in an accommodating portion.
Figure 6:
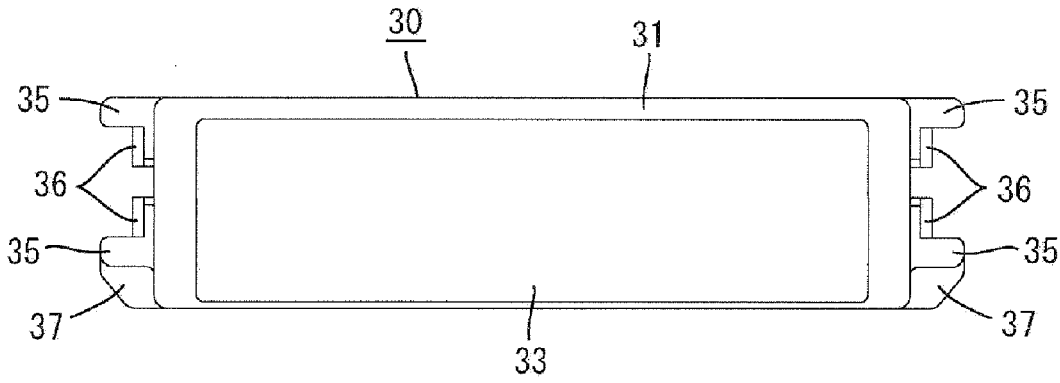
FIG. 6 is a front view of the male-side dummy connector.

The male-side dummy connector 30 is made e.g. of synthetic resin and defines a cap-shape with a front wall 31 extending in the width direction to cover the front end opening of the second accommodating portion 25. A rectangular tubular peripheral wall 32 extends back from the peripheral edge of the front wall 31 over substantially the entire periphery. As shown in FIG. 6, the front surface of the front wall 31 is closed surface and a middle part of the front wall 31 defines a bulge 33 that projects slightly forward. The bulge 33 fits into a fitting recess 15G in the plate main body 15A of the moving plate 15 at the retracted position. As shown in FIG. 4, vertical walls 34 are arranged at intervals in the width direction in the male-side dummy connector 30 to connect the upper and lower inner surfaces of the peripheral wall 32.

Figure 5:
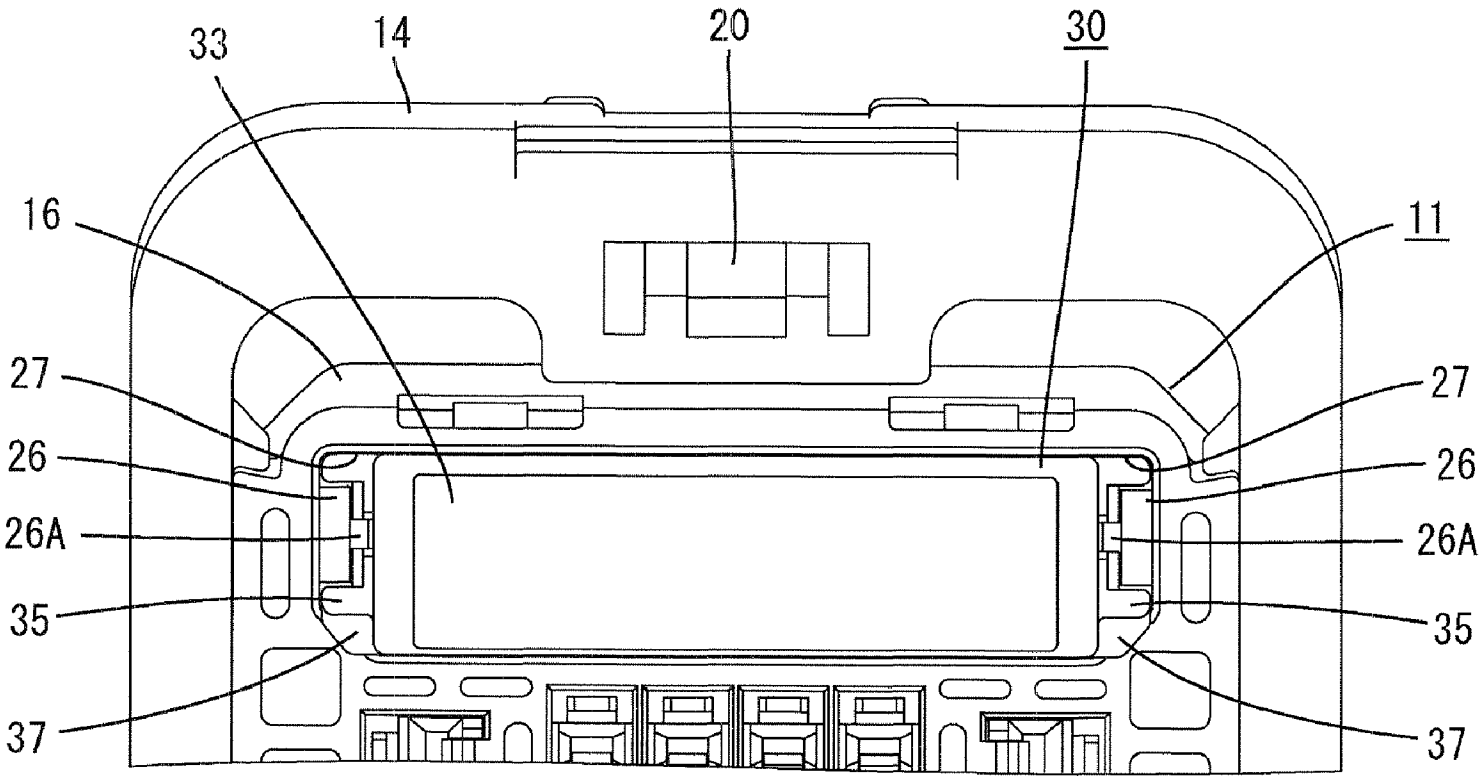
FIG. 5 is an enlarged rear view of the male-side dummy connector reversed forward/backward so that insertion thereof into the second accommodating portion is prevented.
Figure 8:
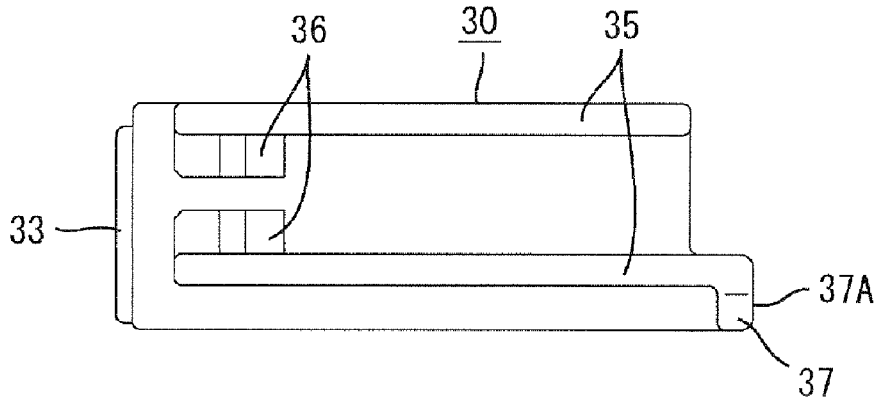
FIG. 8 is a side view of the male-side dummy connector.

As shown in FIG. 8, long narrow guiding projections 35 extend parallel to one another in forward and backward directions at upper and lower positions on opposite outer side surfaces of the peripheral wall 32 for guiding the insertion of the male-side dummy connector 30 into the second accommodating portion 25. Upper and lower locks 36 project from the inner surfaces of front end sides of the both guiding projections 35 to face each other, and a clearance is defined between the locks 36. On the other hand, as shown in FIG. 5, interlocking portions 26 project from the opposite side surfaces of the inner wall of the second accommodating portion 25 and are resiliently deformable in a lateral direction. The locks 36 engage with the corresponding interlocking portions 26 to retain the male-side dummy connector 30 in the second accommodating portion 25 when the male-side dummy connector 30 is inserted to a proper depth into the second accommodating portion 25. Restrictions 26A are formed in central parts of the interlocking portions 26 in the height direction, and loose movements of the both interlocking portions 26 are restricted in the height direction by the entry of the restrictions 26A into the clearances between the locks 36. Therefore the locks 36 and the restrictions 26A are engaged and held stably. The opposite sides of the interlocking portions 26 in the second accommodating portion 25 define upper and lower guiding grooves 27 along which the guiding projections 35 are slidable. A structure made up of these interlocking portions 26 and guiding grooves 27 also is formed in the first accommodating portion 23. As shown in FIG. 2, the plate main body 15A of the moving plate 15 is formed with windows 15E at positions to face the interlocking portions 26, so that a locked state by the interlocking portions 26 can be canceled through the windows 15E.

Figure 7:
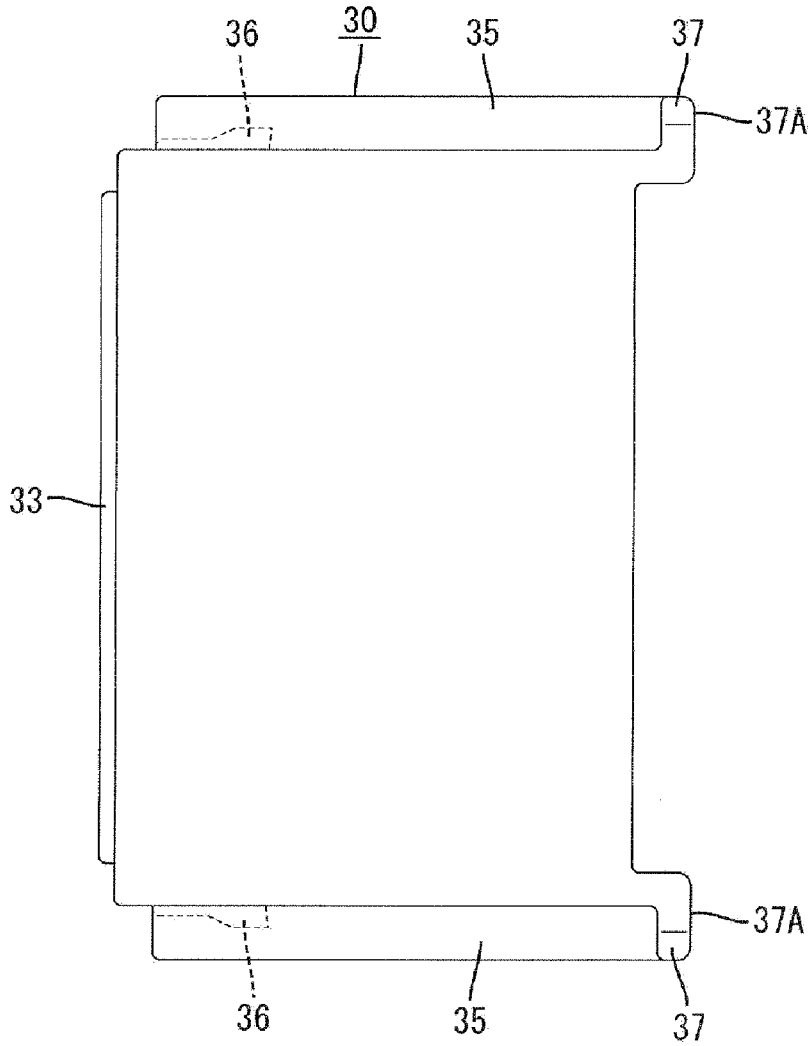
FIG. 7 is a bottom view of the male-side dummy connector.

As shown in FIGS. 6 to 8, two substantially plate-like protrusions 37 project sideways at the rear ends of the opposite outer surfaces of the peripheral wall 32. The protrusions 37 project from the rear end of the male-side dummy connector 30 and are connected unitarily with the rear ends of the lower guiding projections 35 and elongate the guiding projections 35 down substantially perpendicularly to the extending direction of the lower guiding projections 35. Specifically, the laterally projecting ends of the protrusions 37 align with the projecting ends of the guiding projections 35 and the bottom ends of the protrusions 37 align with the outer lower surface of the peripheral wall 32. The bottom ends and the side ends of the projections 37 are connected by slanted edges formed by obliquely chamfering corners. The rear surfaces of the protrusions 37 are substantially vertical and define flat portions 37A of a size suitable to be pushed by fingers.

An attempt could be made to insert the male-side dummy connector 30 into the second accommodating portion 25 while holding it improperly oriented, such as a forward/backward reversal. However, the protrusions 37 interfere with the opening edge of the insertion opening of the second accommodating portion 25 to prevent the insertion of the male-side dummy connector main body 30. On the other hand, the male-side dummy connector 30 can be inserted in a proper posture into the second accommodating portion 25. Thus, parts of the male-side dummy connector 30 excluding the protrusions 37 are inserted to the proper depth into the second accommodating portion 25 and the protrusions 37 are located outside the insertion opening without being inserted into the second accommodating portion 25.

Figure 9:
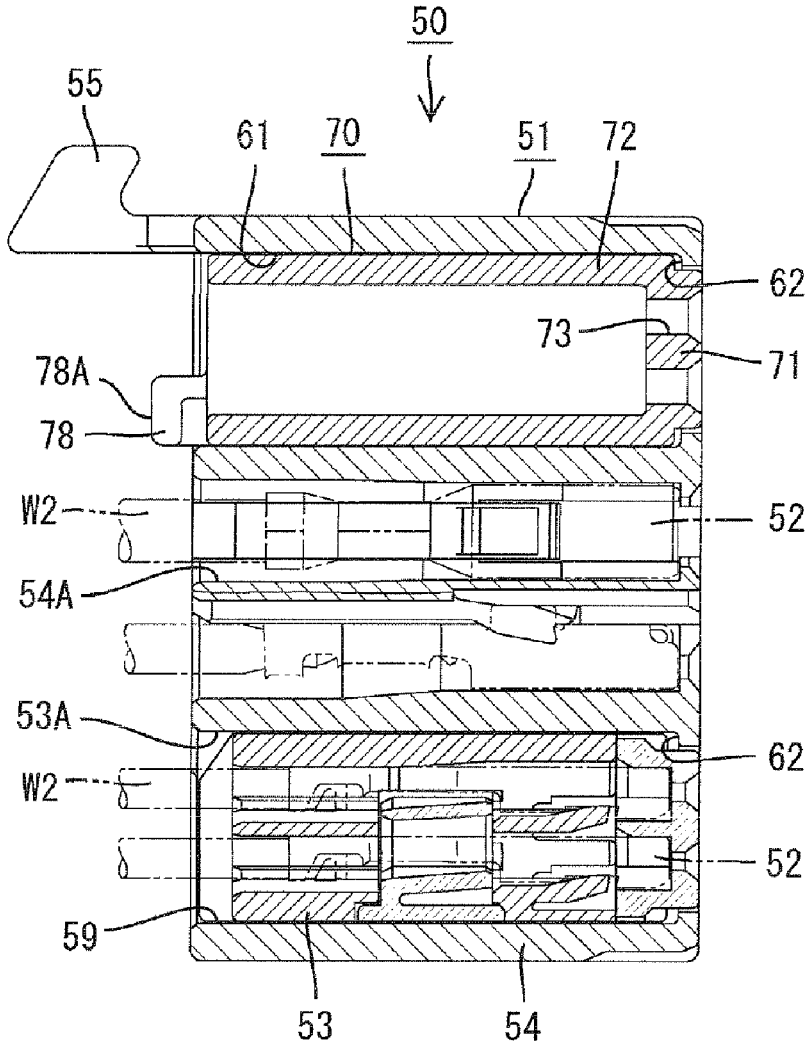
FIG. 9 is a side view in section of a female connector.

The female housing 51 also is made e.g. of synthetic resin and includes a substantially rectangular block-shaped housing main body 54, as shown in FIG. 9. The engaging portion 55 projects back at the rear end of the upper surface of the housing main body 54. When the two housings 11, 51 are properly connected, the housing main body 54 excluding the engaging portion 55 is fit into the receptacle 17 and the engaging portion 55 is resiliently engaged with the lock 20 of the lever 14 after having reached the connection position.

Figure 11:
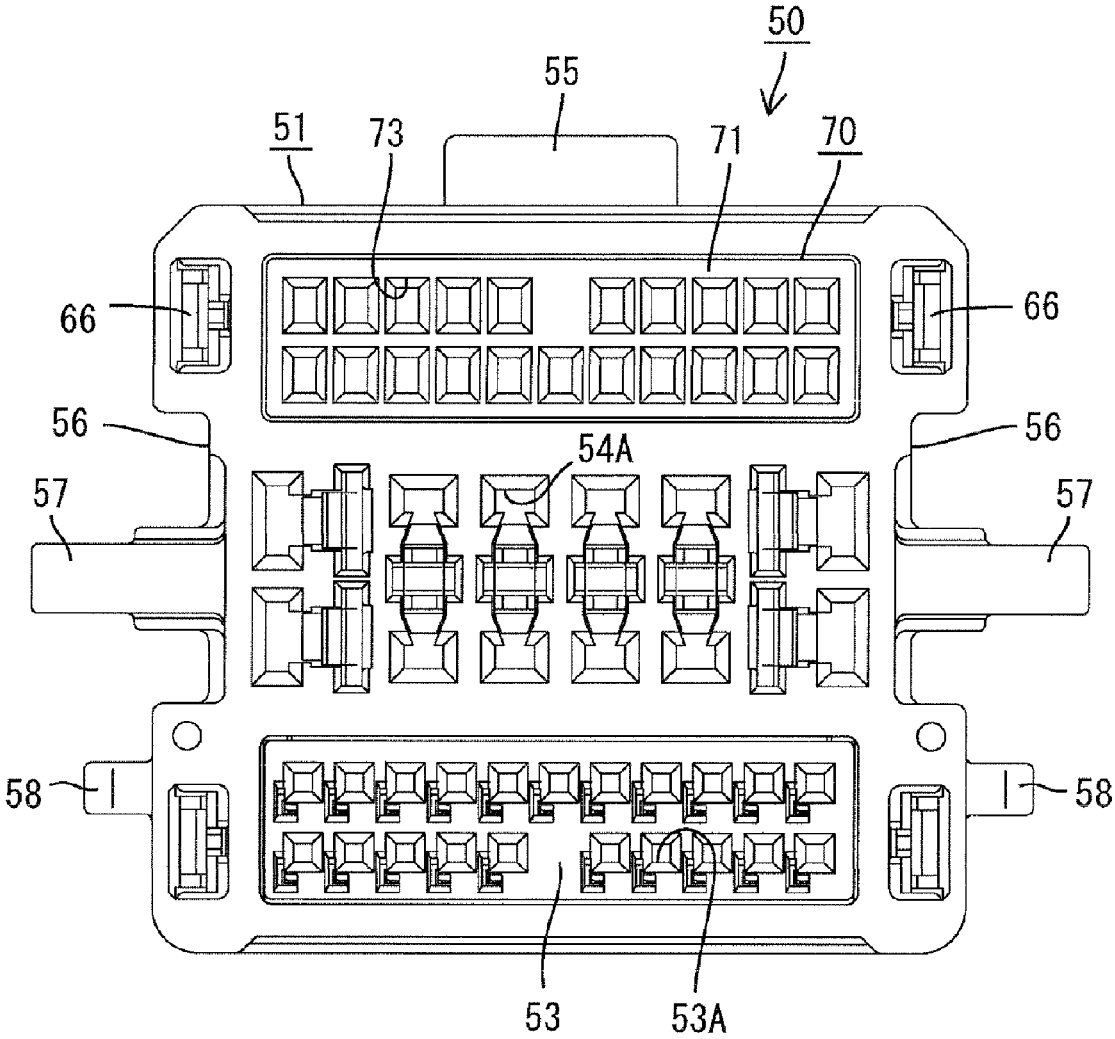
FIG. 11 is a front view of the female connector.
Figure 12:
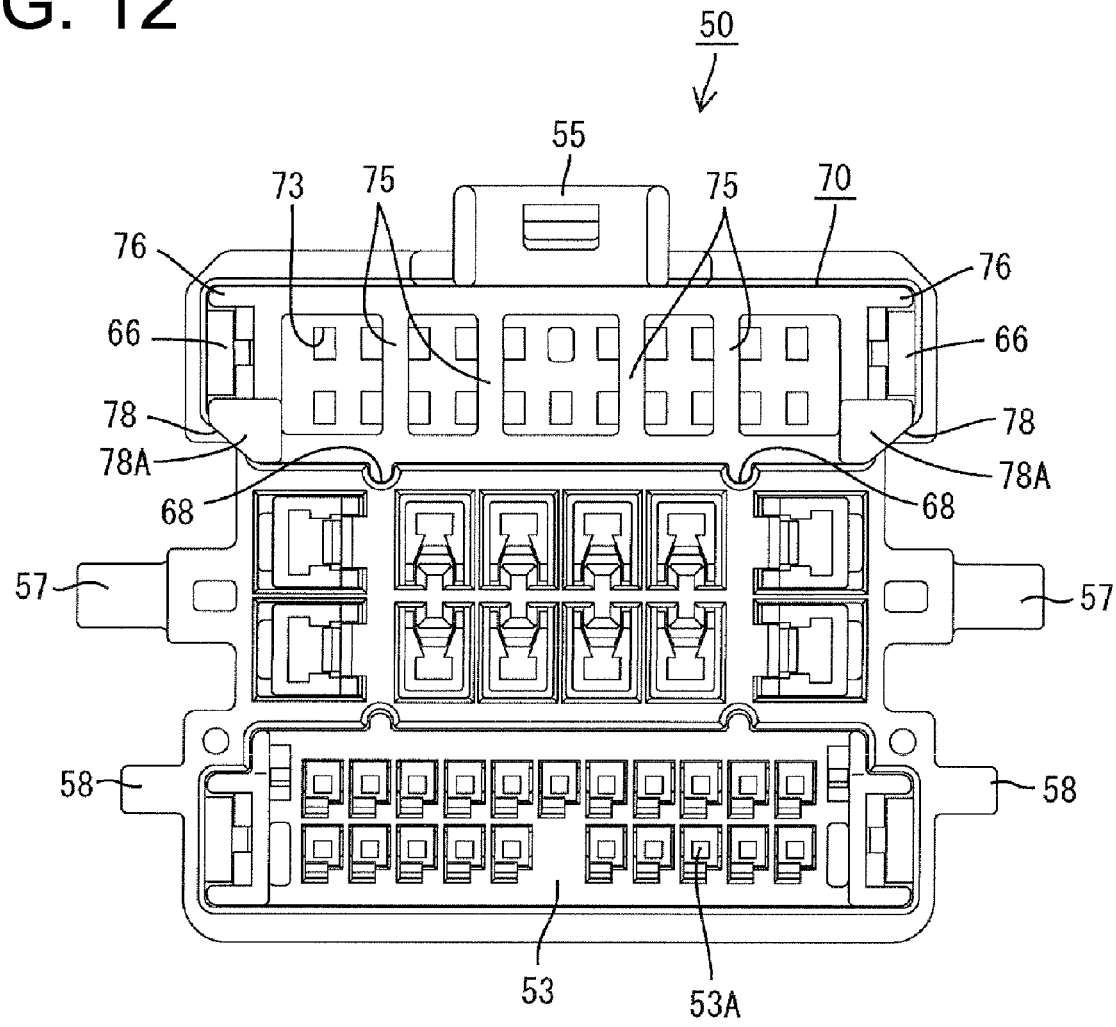
FIG. 12 is a rear view of the female connector.
Figure 13:
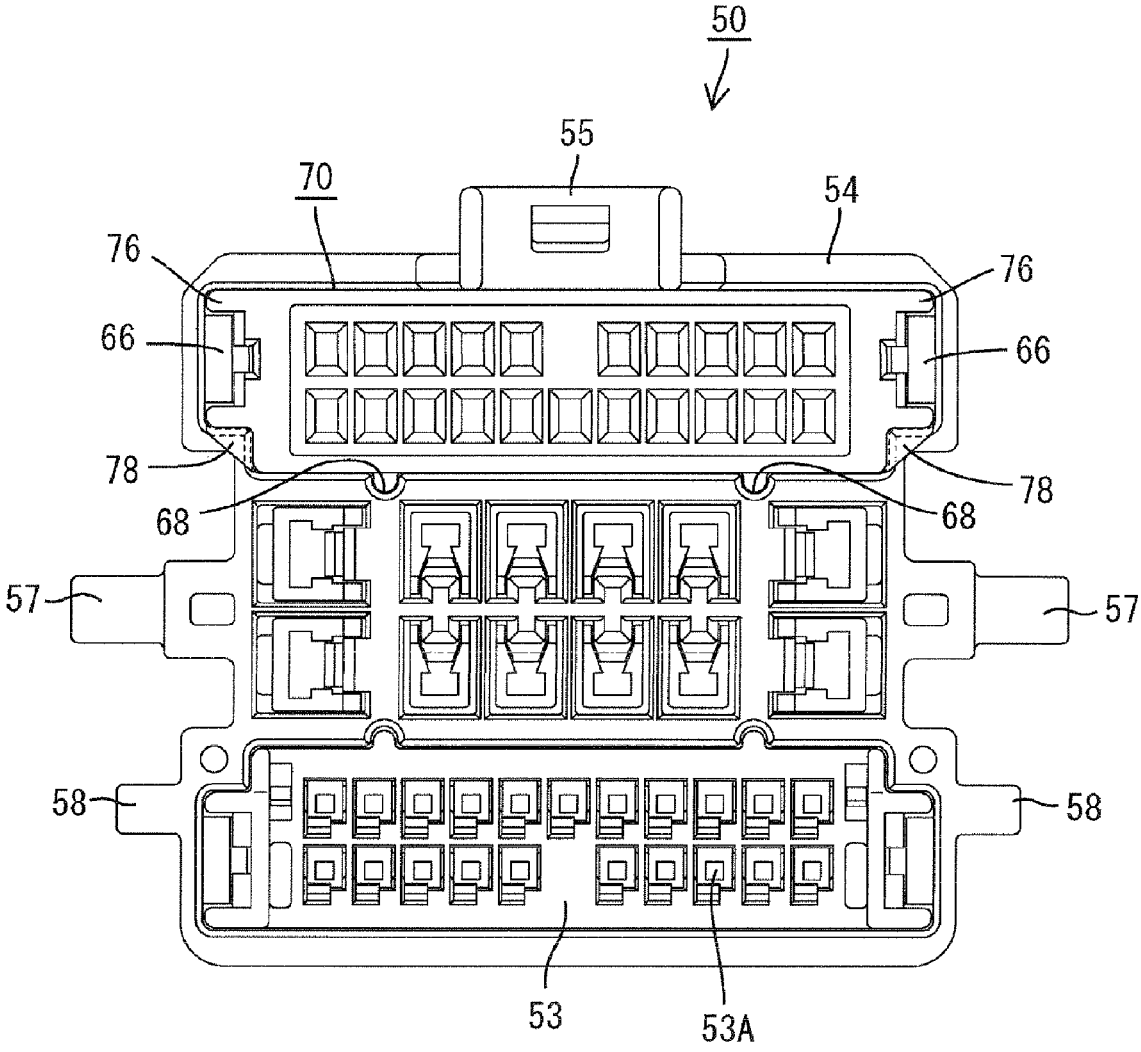
FIG. 13 is a rear view showing the female-side dummy connector held forward/backward reversed so that insertion thereof into an accommodating portion is prevented.

As shown in FIG. 11, recesses 56 are formed in opposite side surfaces of the housing main body 54 at intermediate positions along the height direction so that the intermediate part is narrower than upper or lower parts of the housing main body 54. Cam followers 57 project laterally from the bottom surfaces of the recesses 56 and enter the cam grooves 14E via the introducing grooves 21 in the process of connecting the two housings 11, 51. The cam followers 57 display a cam action by moving in the cam grooves 14E as the lever 14 is rotated and function to connect the two housings 11, 51 with a low operating force. The cam followers 57 also are engageable with the moving plate 15, so that the moving plate 15 is movable to the advanced position and the retracted position as the lever 14 is rotated.

Figure 10:
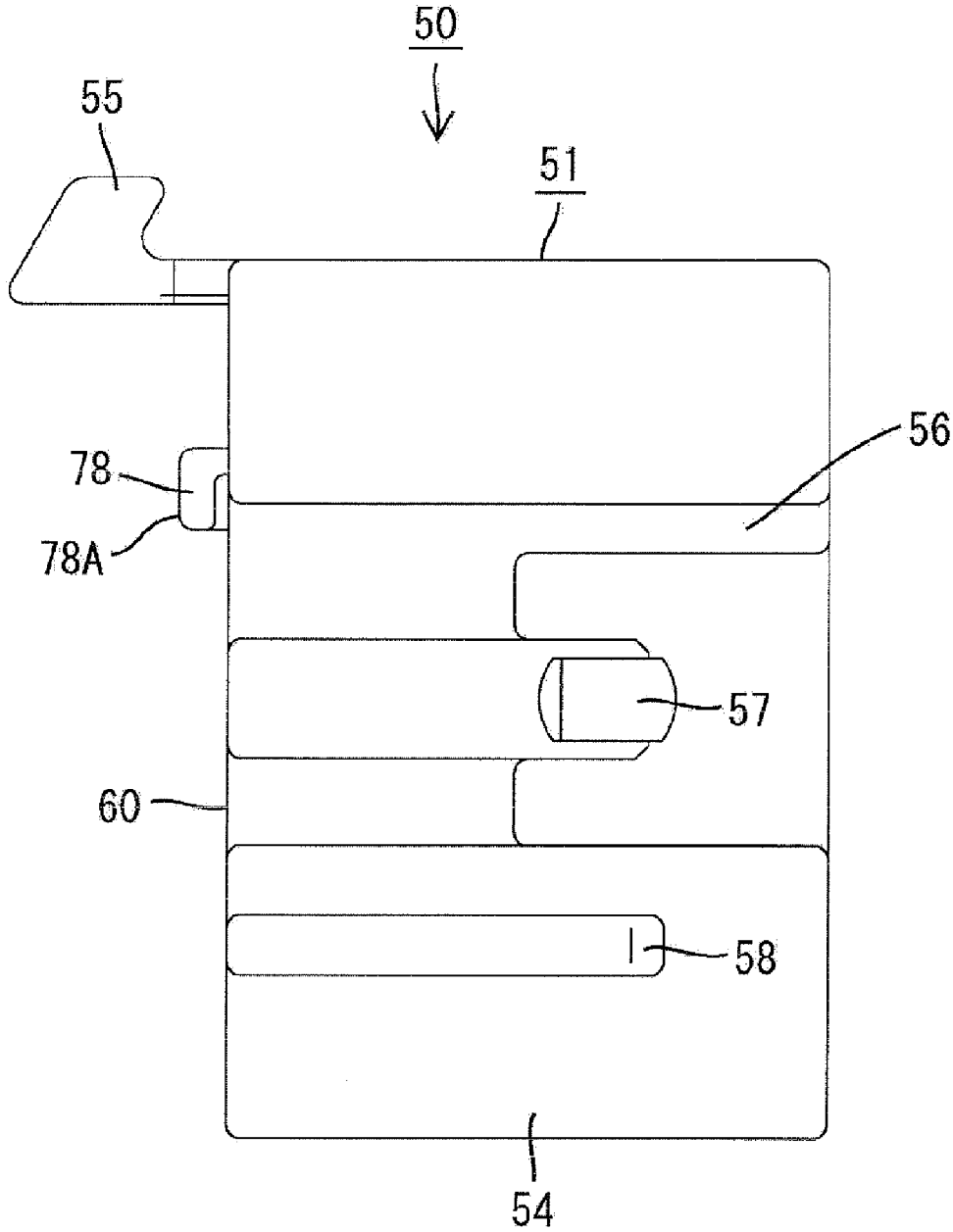
FIG. 10 is a side view of the female connector.

Unlocking portions 58 project from lower areas of the opposite side surfaces of the housing main body 54. The unlocking portions 58 interfere with the resilient locking pieces 14F of the lever 14 in the process of connecting the two housings 11, 51 and disengage the resilient locking pieces 14F from the engaging grooves 22. As shown in FIG. 10, the unlocking portions 58 are long narrow ribs that extend in forward and backward directions.

Cavities 54A penetrate an intermediate part of the housing main body and extend in forward and backward directions. Large female terminal fittings 52 are insertable into the cavities 54A from behind.

A third accommodating portion 59 penetrates the lower part of the housing main body 54 in forward and backward directions and the female housing part 53 can be inserted into the third accommodating portion 59 from the rear. Cavities 53A are formed in upper and lower levels and penetrate the female housing part 53 in forward and backward directions. Small female terminal fittings 52 are insertable into the respective cavities 53A from behind. The rear end surface of the housing main body 54 is substantially vertical, and an area thereof from the intermediate part to the lower part defines a wire draw-out surface 60, through which wires W2 connected with the female terminal fittings 52 are drawn out.

Figure 14:
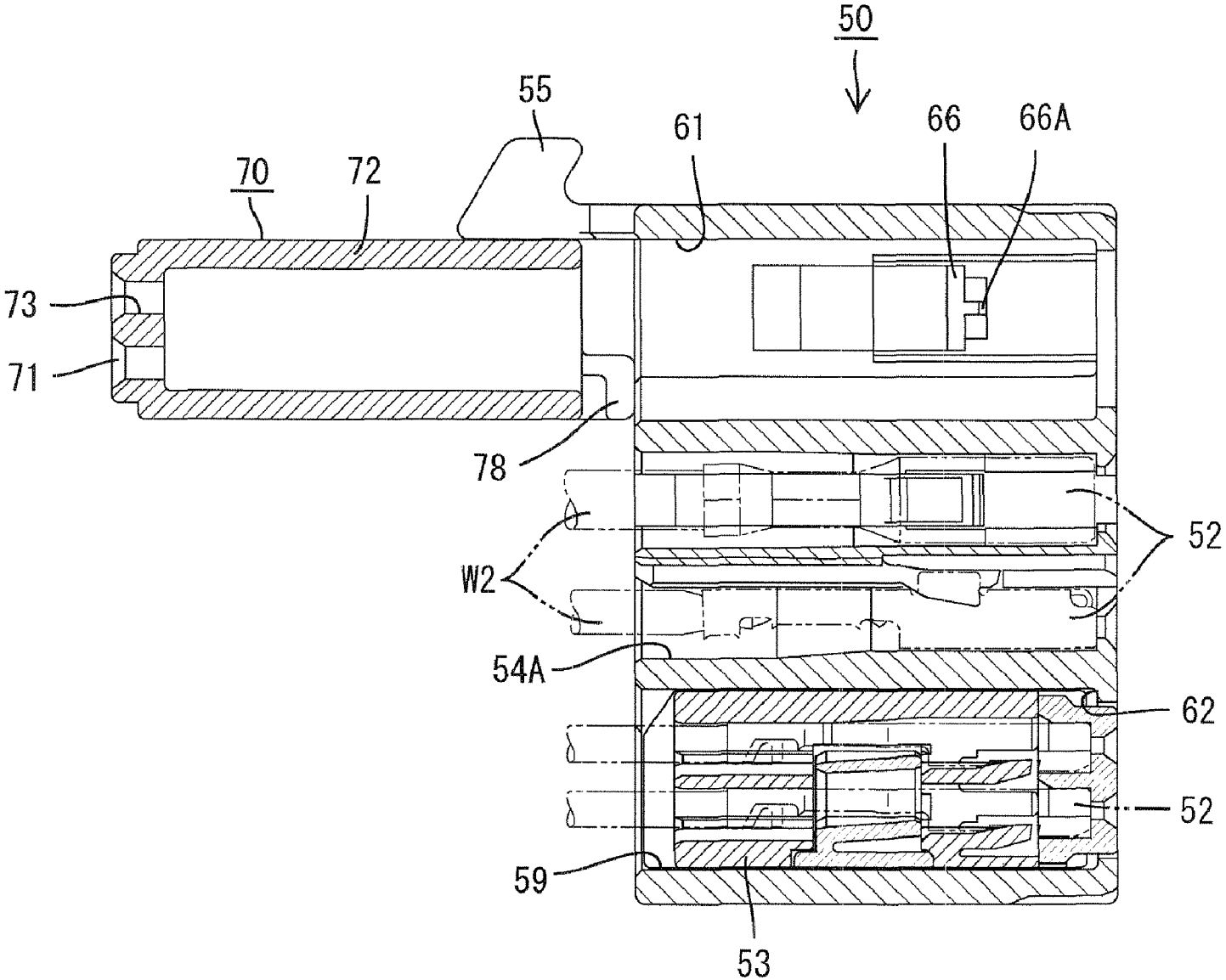
FIG. 14 is a side view in section showing the state where the female-side dummy connector is held forward/backward reversed and the insertion into the accommodating portion is prevented.

A fourth accommodating portion 61 penetrates the upper part of the housing main body 54 in forward and backward directions and has substantially the same shape as the third accommodating portion 59. The rear end opening of the fourth accommodating portion 61 defines an insertion opening for receiving the female-side dummy connector 70. Steps 62 are formed in the inner walls of the third and fourth accommodating portions 59 and 61 for stopping the female-side dummy connector main 70 and the female-side housing part 53 at their front end positions. A bulge 74 of the properly inserted female-side dummy connector 70 fits between the steps 62. The structure of the housing main body 54 is substantially the same as that of the terminal accommodating portion 16, and the structure of the female-side housing part 53 is substantially the same as that of the male-side housing part 13. More particularly, as shown in FIG. 14, the third and fourth accommodating portions 59, 61 are formed with locks 66 and restrictions 66A having the same shapes as the interlocking portions 26 and the restrictions 26A of the first and second accommodating portions 23, 25.

Figure 15:
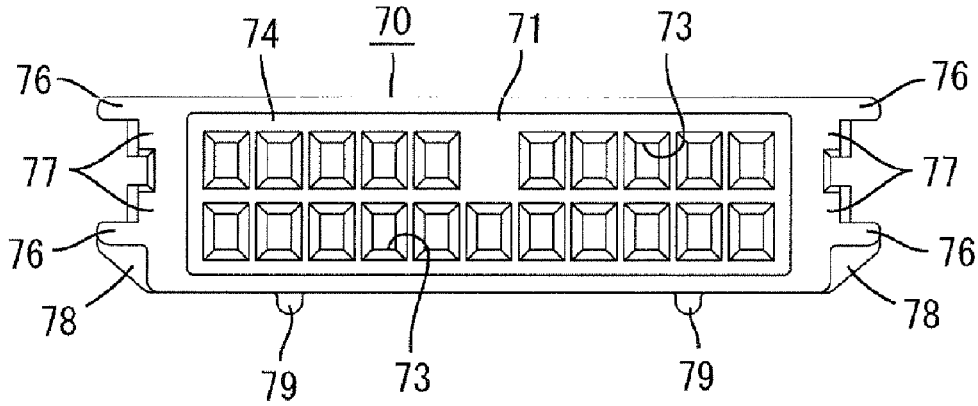
FIG. 15 is a front view of the female-side dummy connector.
Figure 16:
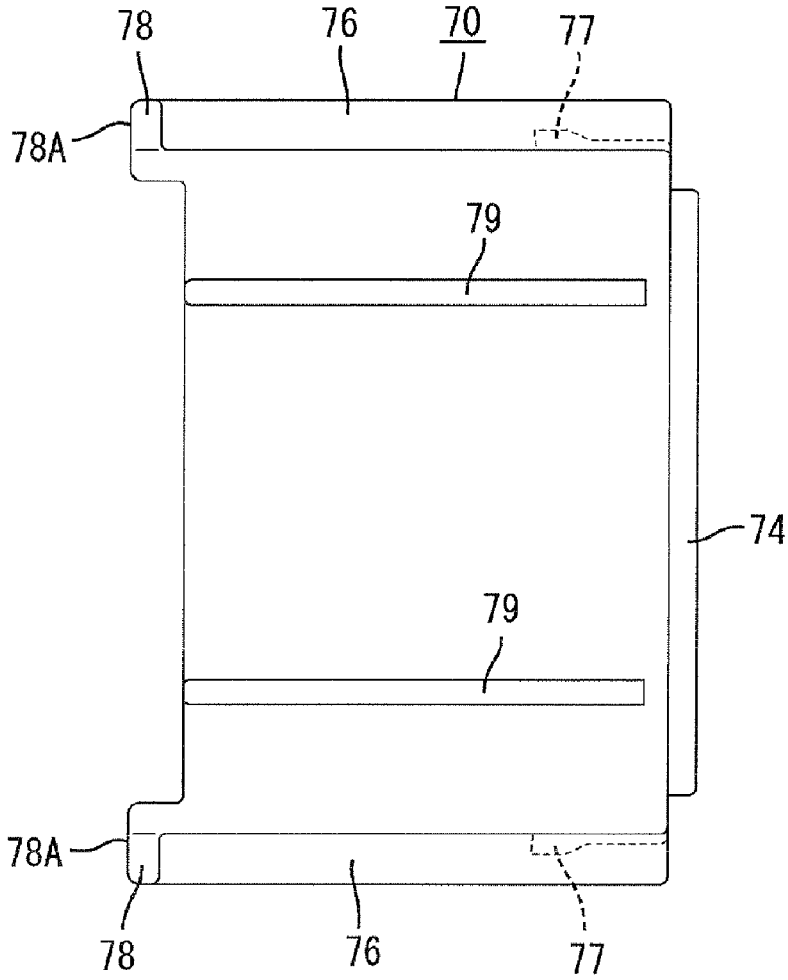
FIG. 16 is a bottom view of the female-side dummy connector.
Figure 17:
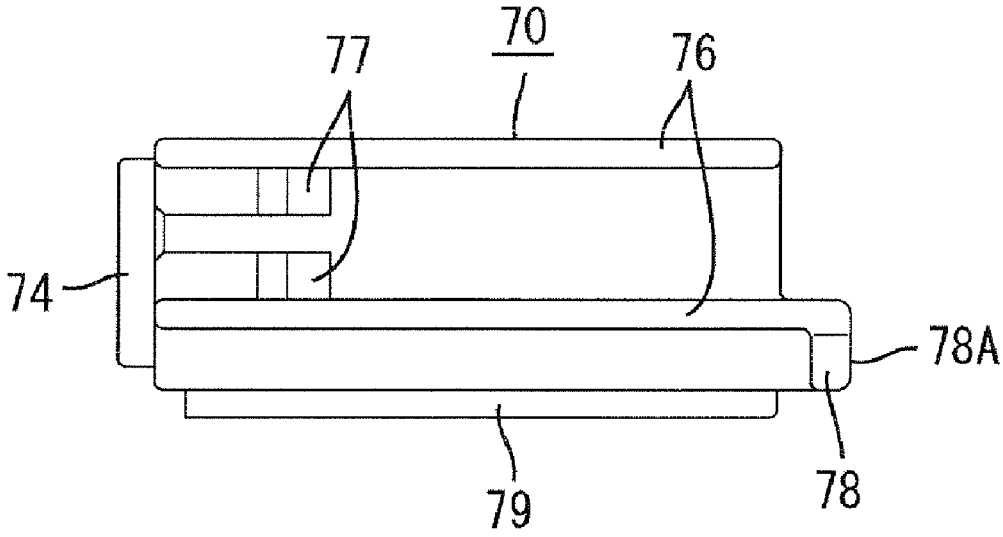
FIG. 17 is a side view of the female-side dummy connector.

The female-side dummy connector 70 is made e.g. of synthetic resin. More particularly, the female-side dummy connector 70 is substantially cap-shaped and includes a front wall 71 extending in the width direction to cover the front end opening of the fourth accommodating portion 61. A peripheral wall 72 extends back from the peripheral edge of the front wall 71 over substantially the entire periphery. As shown in FIG. 15, tab insertion openings 73 penetrate the front wall 71 and can receive tabs 12A of the male terminal fittings 12 if the male-side housing part 13 should be accommodated into the second accommodating portion 25, thereby permitting the tabs 12A to escape. The female-side dummy connector 70 has substantially the same structure as the male-side dummy connector 30 and includes a bulge 74, vertical walls 75, guiding projections 76, locks 77, protrusions 78 and flat portions 78A forming the rear end surfaces of the protrusions 78, all of which have substantially the same shapes as the corresponding parts of the male-side dummy connector 30.

The female-side dummy connector 70 has guiding ribs 79 in addition to the guiding projections 76 and the fourth accommodating portion 61 has guiding-rib receiving portions 68 for receiving the corresponding guiding ribs 79. The female-side dummy connector 70 and the fourth accommodating portion 61 differ from the male-side dummy connector 30 and the second accommodating portion 25 in that two laterally spaced guiding ribs 79 extend in forward and backward directions along the lower surface of the peripheral wall 72 and two laterally spaced guiding-rib receiving portions 68 are formed in the lower surface of the inner wall of the fourth accommodating portion 61.

Prior to connecting the two housings 11, 51, the large male terminal fittings 12 are inserted into the corresponding cavities 16A of the male housing 11, the male-side housing part 13 having the small-size male terminal fittings 12 accommodated therein is inserted into the first accommodating portion 23 of the male housing 11 and the male-side dummy connector 30 is inserted into the second accommodating portion 25 of the male housing 11. Further, the large female terminal fittings 52 are inserted into the cavities 54A of the female housing 51, the female-side housing part 53 having the small female terminal fittings 52 accommodated therein is inserted into the third accommodating portion 59 of the female housing 51 and the female-side dummy connector 70 is inserted into the fourth accommodating portion 61 of the female housing 51.

The male-side dummy connector 30 then is disposed in a proper posture and is inserted into the second accommodating portion 25 through the insertion opening with the bulge 33 in the lead and is guided smoothly to a proper insertion position by sliding movements of the guiding projections 35 in the guiding grooves 27. The locks 36 resiliently lock the interlocking portions 26 at the proper insertion position to prevent the male-side dummy connector 30 from coming out backward. At this time, as shown in FIGS. 1 and 4, the protrusions 37 of the male-side dummy connector 30 project out from the insertion opening together with the wires W1 connected with the male terminal fittings 12 at the wire draw-out surface 24 of the male housing 11. Accordingly, there is a visual or tactile confirmation that the male-side dummy connector 30 has reached the proper insertion position. Further, the protrusions 37 contact the opening edge of the insertion opening of the second accommodating portion 25 to stop the male-side dummy connector 30 at its front end position. The insertion and mounted state of the female-side dummy connector 70 into the fourth accommodating portion 61 are substantially the same as in the case of the male-side dummy connector 30. The male-side and female-side dummy connectors 30, 70 can be inserted smoothly by pushing the protrusions 37, 78 forward while placing fingers on the flat portions 37A, 78A.

The two housings 11, 51 then are fit lightly with the lever 14 at the initial position. The cam followers 57 then are inserted into the entrances of the cam grooves 14E and the locked states by the resilient locking pieces 14F are canceled by the unlocking portions 58 to permit the displacement of the rotation of the lever 14 toward the connection position. The lever 14 then is rotated in a counterclockwise direction toward the connection position. Thus, the cam followers 57 move along the cam grooves 14E, the moving plate 15 moves toward the retracted position and the tabs 12A of the male terminal fittings 12 are inserted into the corresponding female terminal fittings 52. The engaging portion 55 resiliently locks the lock 20 of the lever 14 to prevent the rotation of the lever 14 when the two housings 11, 51 are connected properly. Therefore, the two housings 11, 51 are held securely, and the male and female terminal fittings 12, 52 are connected electrically. At this time, the male-side and female-side dummy connectors 30, 70 are positioned to face each other via the plate main body 15A of the moving plate 15.

The male-side dummy connector 30 could be held in the improper posture such as forward/backward reversed. In this situation, the protrusions 37 contact the lower two corners of the opening edge of the insertion opening and the male-side dummy connector 30 can not be inserted into the second accommodating portion 25 at all, as shown in FIG. 5. This also applies for the female-side dummy connector 70. If the female-side dummy connector 70 is oriented improperly such as being forward/backward reversed, the protrusions 78 contact with the lower two corners of the opening edge of the insertion opening of the fourth accommodating portion 61 and the female-side dummy connector 70 can not be inserted into the fourth accommodating portion 61 at all, as shown in FIG. 14.

As described above, the protrusions 37, 78 interfere with the opening edge of the insertion opening of the second accommodating portion 45 or fourth accommodating portion 61 to prevent the insertion if the dummy connector 30, 70 is not inserted in the proper posture. Thus, an erroneous insertion of the dummy connector 30, 70 is prevented. In this case, the protrusions 37, 78 are not inserted into the second accommodating portion 45 or fourth accommodating portion 61, and it is not necessary to provide second accommodating portion 45 or fourth accommodating portion 61 with escaping structures for the protrusions 37, 78. Therefore the construction can be simplified and the enlargement of the second accommodating portion 45 or fourth accommodating portion 61 can be avoided. Further, if the dummy connector 30, 70 is in the proper posture, the protrusions 37, 78 project out from the insertion opening and it can be understood or confirmed by visual or tactile confirmation that the dummy connector 30, 70 is inserted properly in the second accommodating portion 45 or fourth accommodating portion 61 and it can be prevented that the insertion of the dummy connector 30, 70 is forgotten.

Further, the insertion openings of the second accommodating portion 45 and/or fourth accommodating portion 61 are at the same sides as the wire draw-out surfaces 24, 60 of the male and female housings 11, 51. Thus, the wires W1, W2 are to be located substantially side by side with the protrusions 37, 78 projecting from the opening edges of the insertion openings, and dead spaces in arrangement directions of the wires W1, W2 can be utilized effectively. Further, the wires W1, W2 prevent only the projecting states of the protrusions 37, 78 from standing out and problems such as the interference of the protrusions 37, 78 with other components are unlikely.

Flat portions 37A, 78A are defined at the rear end surfaces of the protrusions 37, 78 preferably serve as the flat portions 37A, 78A and can be pushed by fingers. Thus, the dummy connectors 30, 70 can be inserted into the second accommodating portion 45 and/or fourth accommodating portion 61 while fingers are placed on the flat portions 37A, 78A to improve operability. Further, the construction is simplified as compared with the case where the flat portions 37A, 78A pushable by fingers are provided on parts other than the protrusions 37, 78.

Furthermore, the protrusions 37, 78 are connected unitarily with the rear ends of the guiding projections 35, 76 and are reinforced by the guiding projections 35, 76. Thus, a situation where the protrusions 37, 78 are not likely to be broken due to interference with external matter.

The invention is not limited to the above described and illustrated embodiment. For example, the following embodiments are also included in the technical scope of the present invention.

The accommodating portions capable of accommodating the dummy connectors may be formed in a simple case which accommodates no terminal fitting.

A dummy connector may be at least partly inserted into the first or third accommodating portion instead of the housing part.

The guiding projections and the protrusions may be separated from each other.

What is claimed is:

1. A connector, comprising:

a dummy connector from which no wire is to be drawn out, the dummy connector having opposite front and rear ends and outer surfaces extending between the ends, at least one guiding projection extending along the outer surface from a position in proximity to the front end to the rear end of the dummy connector, and a protrusion extending transversely from at least one of the outer surfaces and from the guiding projection at the rear end of the dummy connector, and a case including an accommodating portion capable of accommodating the dummy connector, an insertion opening formed at one end of the accommodating portion for receiving the dummy connector, wherein the protrusion interferes with an edge of the insertion opening if the dummy connector is oriented improperly while permitting insertion of the dummy connector into the accommodating portion and projecting out from the insertion opening if the dummy connector is in a proper posture.

2. The connector of claim 1, wherein a housing region is arranged side by side with the accommodating portion in the case and can accommodate terminal fittings and from which wires connected with the terminal fittings can be drawn out.

3. The connector of claim 2, wherein the insertion opening is a wire draw-out surface in the housing region.

4. The connector of claim 1, wherein one end of the protrusion has a flat area pushable by a finger.

5. The connector of claim 1, wherein the protrusion is connected unitarily with a rear end of the guiding projection and reinforced by the guiding projection.

6. The connector of claim 1, wherein at least one lock is provided on the dummy connector for engaging at least one interlocking portion of the accommodating portion to retain the properly inserted dummy connector in the accommodating portion.

7. The connector of claim 6, wherein at least two locks project from inner surfaces of two guiding projections facing each other, a clearance being defined between the locks, at least one restriction being formed in the interlocking portion and disposed for entering the clearance between the locks and restricting loose movements of the interlocking portion.

8. The connector of claim 1, wherein a peripheral wall having inner and outer surfaces extends between the front and rear ends of the dummy connector.

9. The connector of claim 1, wherein the case comprises a plurality of accommodating portions.

10. The connector of claim 9, further comprising a male side housing accommodated in one of the accommodating portions, a plurality of terminal fittings being mounted in the male side housing.

11. A connector, comprising:

a case having opposite front and rear ends and first and second accommodating portions extending between the front and rear ends;

a housing mounted in the first accommodating portion of the case;

a plurality of terminal fittings mounted in the housing; and a dummy connector mounted in the second accommodating portion, the dummy connector having a closed front end substantially aligned with the front end of the case and a rear end opposite the closed front end, outer surfaces extending between the front and rear ends of the dummy connector, at least one guiding projection extending along the outer surface from a position in proximity to the front end to the rear end of the dummy connector and at least one protrusion extending transversely from at least one of the outer surfaces and from the guiding projection at the rear end of the dummy connector, the protrusion being dimensioned to prevent the rear end of the dummy connector from being inserted into the accommodating portion and projecting beyond the rear end of the case when the dummy connector is inserted properly in the accommodating portion.

12. The connector of claim 11, wherein the at least one guiding projection comprises two guiding projections formed on opposite outer surfaces of the dummy connector and the at least one protrusion comprises two protrusions on the opposite side surfaces.

13. The connector of claim 12, wherein each of the protrusions has a substantially planar pushing surface and aligned perpendicular to a front to rear direction of the dummy connector at the rear end of the dummy connector.

14. The connector of claim 13, wherein a projecting distance of the protrusion from the outer surface of the dummy connector is substantially equal to a projecting distance of the guiding projection so that outer parts of the protrusion and the guiding projection are substantially flush.

* * * * *